US006135239A

United States Patent [19]

Martin et al.

[11] Patent Number: 6,135,239

[45] **Date of Patent: *Oct. 24, 2000**

[54] FIRE ESCAPE LADDER

[76] Inventors: Robert J. Martin; Theresa K. Martin, both of Grand Rapids, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/944,756

[22] Filed: Oct. 6, 1997

[51] Int. Cl.[7] ..... A62B 1/06

[52] U.S. Cl. ..... 182/70; 182/35; 182/196; 182/198; 228/40

[58] Field of Search ..... 182/70, 35, 76, 182/190, 196, 197, 198; 228/40

[56] References Cited

U.S. PATENT DOCUMENTS

| | | | |
|---|---|---|---|
| 113,311 | 4/1871 | Laynor et al. | 182/76 |
| 149,328 | 4/1874 | Mulford . | |
| 162,398 | 4/1875 | Matteson . | |
| 197,059 | 11/1877 | Stevenson . | |
| 293,627 | 2/1884 | Butler | 182/70 |
| 331,736 | 12/1885 | Rose | 182/196 |
| 375,107 | 12/1887 | Thelen | 182/196 |
| 433,061 | 7/1890 | Aarons | 182/76 |
| 600,346 | 3/1898 | Hensel | 182/197 |
| 639,902 | 12/1899 | Mace | 182/70 |
| 644,265 | 2/1900 | Thirion | 182/197 |
| 672,544 | 4/1901 | Woodruff | 182/190 |
| 816,896 | 4/1906 | Bihl | 182/197 |
| 1,123,029 | 12/1914 | Smith | 182/70 |
| 1,190,334 | 7/1916 | Spalding | 228/40 |
| 1,612,126 | 12/1926 | James | 182/70 |
| 1,647,684 | 11/1927 | Canizaro | 182/70 |
| 1,816,702 | 7/1931 | Small | 182/197 |
| 2,223,980 | 12/1940 | Zent | 228/40 |
| 2,317,459 | 4/1943 | Hillebrand | 228/44 |
| 2,607,523 | 8/1952 | Williams et al. | 182/198 |
| 2,990,908 | 7/1961 | Wozniak | 182/70 |
| 3,075,612 | 1/1963 | Gould | 182/196 |
| 3,307,654 | 3/1967 | Green et al. | 182/198 |
| 3,329,238 | 7/1967 | Guldi | 182/70 |
| 3,664,457 | 5/1972 | York | 182/70 |
| 3,677,366 | 7/1972 | Loeffel | 182/70 |
| 3,727,724 | 4/1973 | Gilbert et al. | 182/198 |
| 3,809,181 | 5/1974 | Staranick et al. | 182/70 |
| 4,079,811 | 3/1978 | Driskell | 182/35 |
| 4,127,184 | 11/1978 | Strohmeyer | 182/70 |
| 4,143,741 | 3/1979 | Souza et al. | 182/198 |

(List continued on next page.)

FOREIGN PATENT DOCUMENTS

| | | |
|---|---|---|
| 1188021 | 1/1968 | United Kingdom . |
| 2262958 | 7/1993 | United Kingdom . |

*Primary Examiner*—Bruce A. Lev
*Attorney, Agent, or Firm*—Price, Heneveld, Cooper, DeWitt & Litton

[57] ABSTRACT

A self-contained fire escape apparatus for mounting in a wall of a building adjacent an associated window includes a collapsible ladder. A cover is securely attached to a first end of the ladder. A box is configured to provide storage space for the ladder and defines a bottom wall, front and rear walls, a pair of sidewalls, and an opening in the front wall. A second end of the ladder is securely anchored to the box. The cover is releasably attached to the box to cover at least a portion of the opening such that a person can manually remove the cover and eject the cover and the first end of the ladder through the associated window. The box is configured for mounting within a building wall in close reception between a pair of upright structural members of the building wall. The collapsible ladder 2 is sufficiently small in its collapsed condition that it fits within the box 8 for storage. The ladder preferably includes a handle link with at least three elongate rigid handle sections that are rigidly interconnected. At least two of the handle sections form integral stand-offs that abut a flat surface to thereby support a first handle section in a spaced-apart relationship from the flat surface such that a person using the ladder can easily and securely grasp the first handle section.

6 Claims, 4 Drawing Sheets

U.S. PATENT DOCUMENTS

| | | | |
|---|---|---|---|
| 4,157,130 | 6/1979 | Aberer | 182/198 |
| 4,161,998 | 7/1979 | Trimble | 182/190 |
| 4,164,991 | 8/1979 | Marra | 182/70 |
| 4,381,046 | 4/1983 | Landem | 182/70 |
| 4,595,075 | 6/1986 | Rodrigue | 182/70 |
| 5,467,841 | 11/1995 | Krumal | 182/70 |
| 5,499,692 | 3/1996 | Brook | 182/196 |
| 5,664,642 | 9/1997 | Williams | 182/70 |
| 5,746,287 | 5/1998 | Durham, Jr. | 182/70 |
| 5,842,539 | 12/1998 | Hough | 182/70 |
| 5,971,105 | 10/1999 | Jacobsen | 182/70 X |

FIRE ESCAPE LADDER

BACKGROUND OF THE INVENTION

The present invention relates to fire escape ladders. In the event of a fire in a building, it is often necessary to for occupants to quickly evacuate the upper floors of the building. Alternate escape means are normally provided in the event that the stairways are not usable due to the fire or smoke resulting therefrom. Numerous fire escape ladders have been developed for use in a building. Prior fire escape ladders include a removable structure that secures one end of the ladder to a window sill. Some prior fire escape ladders require a special window construction, including a sill that is adapted to retain the cover of a storage box, or may include a specialized window frame construction having a built-in fire escape ladder.

SUMMARY OF THE INVENTION

The present invention is a self-contained fire escape apparatus including a fire escape ladder that stores within a box that is configured to be mounted within the wall of a house having a standard stud wall construction to thereby minimize the amount of space required. A removable cover is attached to the fire escape ladder such that the cover is normally mounted flat against the wall surface, but may be quickly and easily removed and ejected through the associated window in the event of a fire or similar emergency requiring evacuation of the building.

Another aspect of the present invention is a handle link for a collapsible ladder that has at least three elongate rigid handle sections that are rigidly interconnected. At least two of the handle sections form integral stand-offs that are adapted to abut a flat surface to thereby support a first handle section in a spaced-apart relationship from the flat surface such that a person using the ladder can easily and securely grasp the first handle section.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
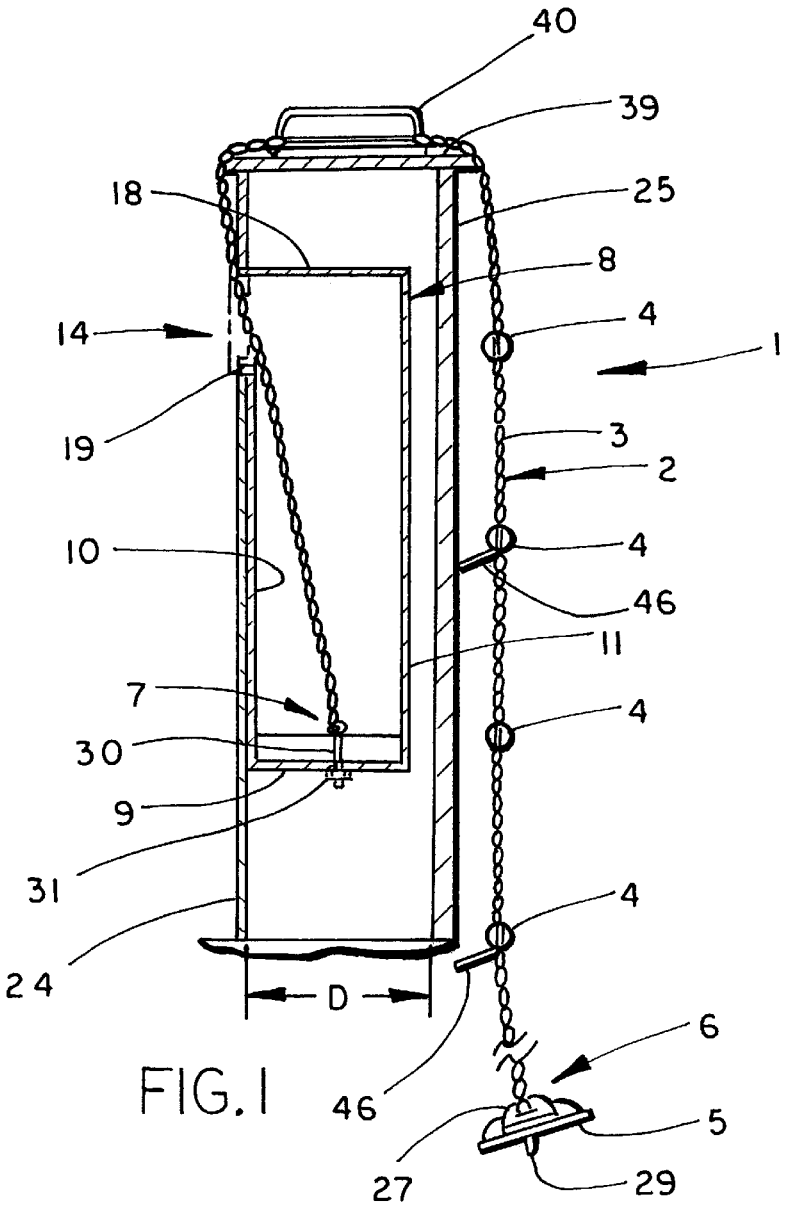
FIG. 1 is a partially fragmentary, side elevational cross-sectional view of the fire escape ladder of the present invention installed within an existing building wall.
Figure 2:
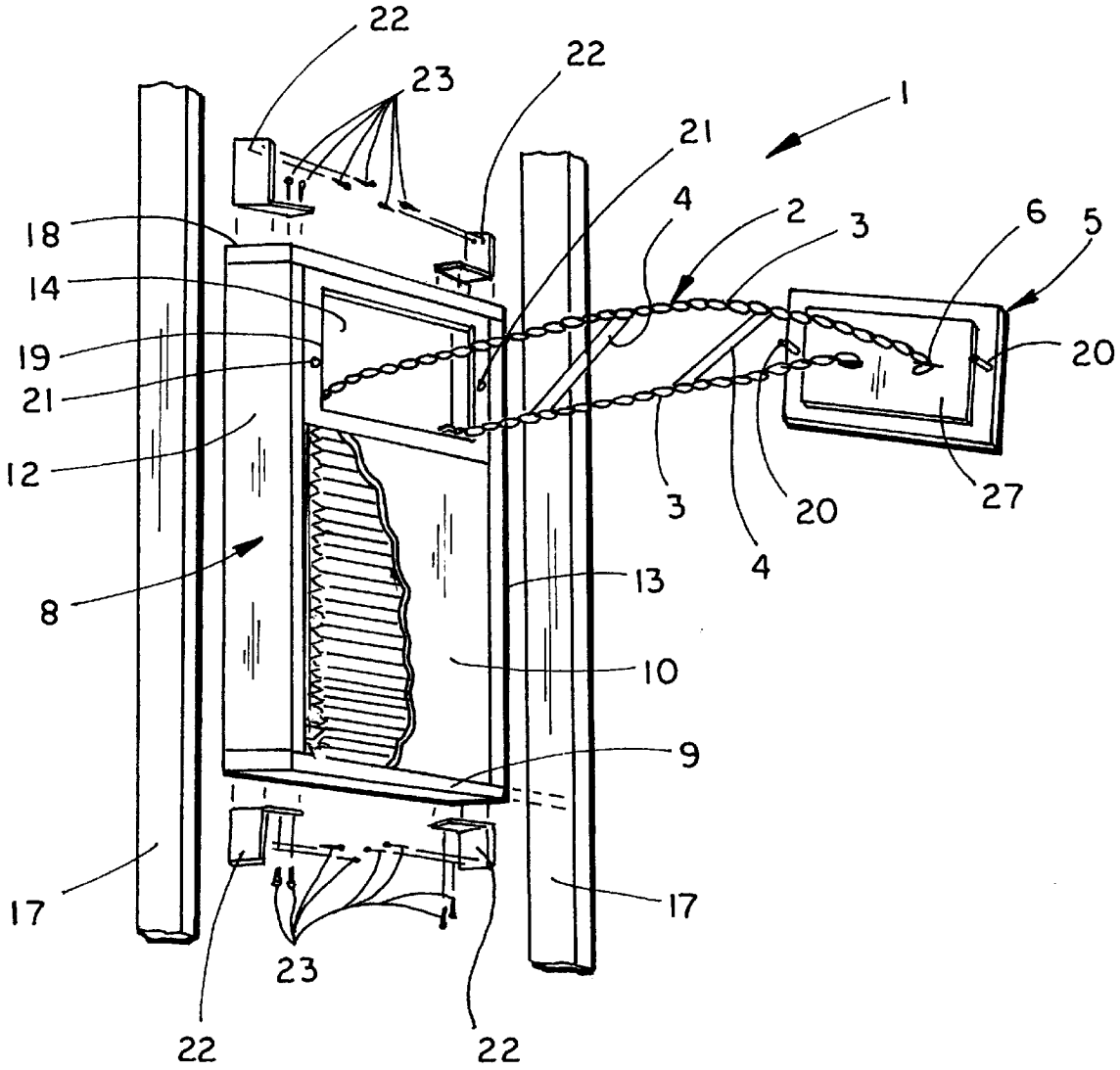
FIG. 2 is an exploded, fragmentary perspective view of the fire escape ladder and structural uprights of an existing building wall.
Figure 3:
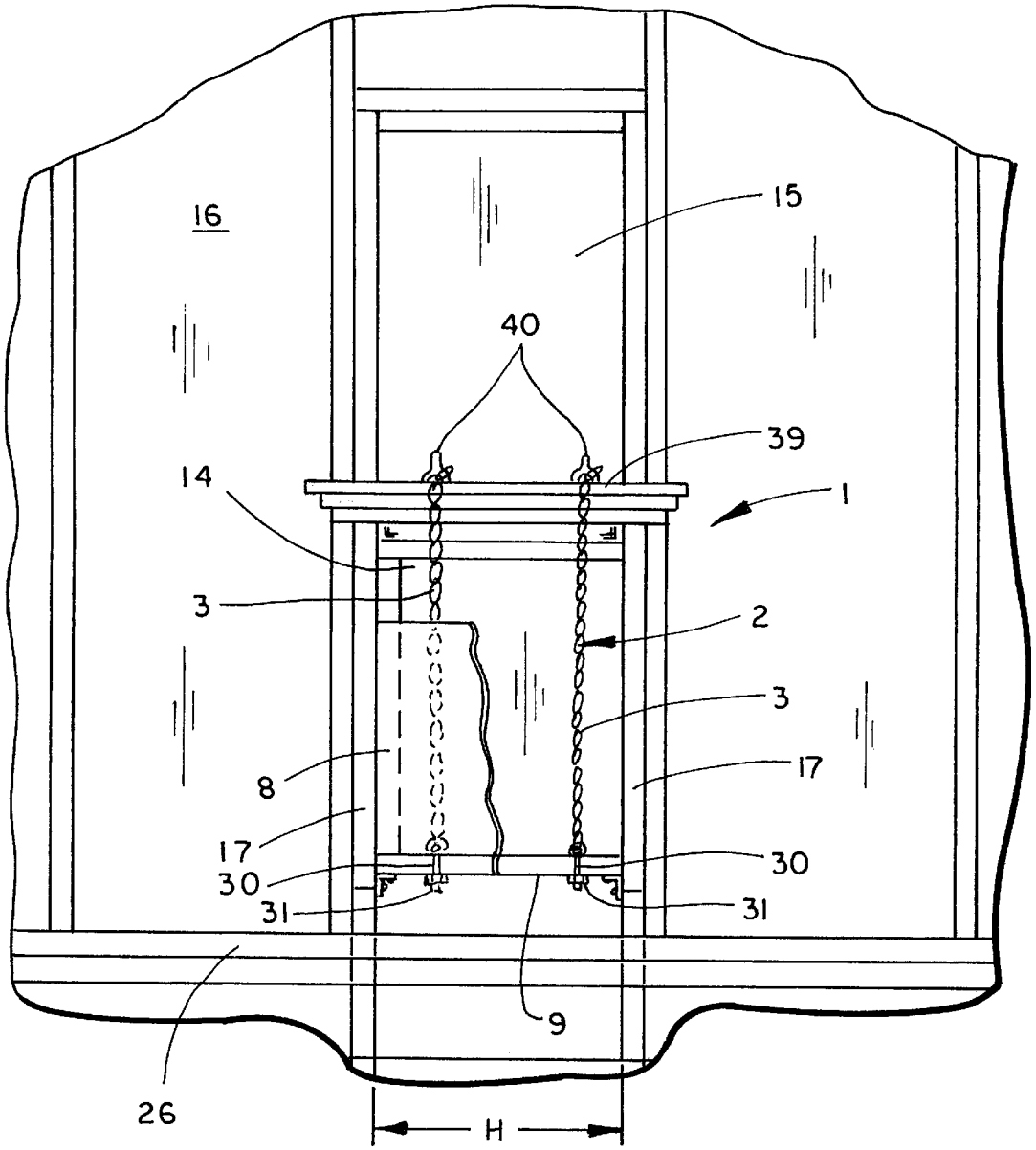
FIG. 3 is a partially fragmentary, front elevational view of the fire escape ladder installed in a building wall below an associated window.

For purposes of description herein, the terms "upper", "lower", "right", "left", "rear", "front", "vertical", "horizontal", and derivatives thereof shall relate to the invention as oriented in FIGS. 1–3. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Self-contained fire escape apparatus 1 of the preferred embodiment includes a ladder 2 stored in box 8 (FIGS. 1–3). Ladder 2 is of a collapsible type such that it can be stored readily in box 8. Ladder 2 includes a pair of elongate flexible support members such as chains 3 and a plurality of cross-members such as rungs 4 interconnecting the chains 3. A cover 5 is securely attached to a first end 6 of ladder 2. Box 8 is configured to provide a storage space for ladder 2 and is defined by a bottom 9, front and rear walls 10, 11 respectively, and a pair of sidewalls 12, 13. Box 8 also defines an opening 14 in front wall 10. A second end 7 of the ladder 2 is securely anchored to box 8. Cover 5 is adapted to be releasably attached to box 8 to cover at least a portion of opening 14 such that a person can manually remove cover 5 and eject cover 5 and first end 6 of ladder 2 through the associated window 15. Box 8 is configured for mounting within a building wall 16 in close reception between a pair of upright structural members such as studs 17 of the building wall 16. The collapsible ladder 2 is sufficiently small in its collapsed condition that it fits within the box 8 for storage.

As best seen in FIG. 2, box 8 preferably includes a top wall 18. The bottom and top walls 9, 18 and the sidewalls 12, 13 are made from wood, and are sized to have sufficient structural strength to withstand the forces generated by a person using the ladder 2. The front and rear walls 10, 11 are made from plywood or similar sheeting material. A wood frame 19 reinforces box 8 in the area of the opening 14, and is adapted to receive the extended inner portion 27 of the cover 5 when in the closed position. Fasteners such as a pair of pegs 20 releasably attach the cover 5 to box 8. Pegs 20 fit into apertures 21 in frame 19, thereby insuring that cover 5 is retained substantially flat against the inner surface of building wall 16, yet allowing cover 5 to be quickly and easily removed in the event of emergency. Other fasteners, such as clips, clasps, and the like may also be used to releasably attach cover 5 in the closed position to box 8.

Upright structural members 17 of the wall of a house in which ladder assembly 1 is being installed are commonly made from "two-by-four" lumber and spaced on 16 inch centers. Since a standard 2"×4" board has a thickness of 1.75 inches, this results in a horizontal spacing "H" (FIG. 3) between the uprights 17 of about 14.25 inches. House walls commonly have a wallboard such as gypsum sheet 24 on the interior side, and a sheet of plywood 25 or similar sheeting on the exterior side. Because a standard 2"×4" has a width of 3.75 inches, shown as "D" in FIG. 1, the corresponding transverse interior space within the wall is 3.75 inches. Box 8 is configured to fit within this standard wall structure without protruding beyond the interior wall surface. The horizontal side-to-side dimension is about 14.25 inches so that it fits snugly between the upright structural members 17, and the maximum front-to-rear dimension is less than about 3.75 inches to allow box 8 to fit within the wall of a standard house or similar structure of 2"×4" or 2"×6" construction.

L-shaped connecting brackets 22 are formed from metal, and rigidly interconnect bottom and top walls 9, 18 of box 8 to upright structural members 17 by means of fasteners, such as wood screws 23. During installation, L-brackets 22 may be positioned against upright structural members 17 and screws 23 driven into bottom and top walls 9, 18 to securely fasten box 8 to upright structural members 17.

As illustrated in FIGS. 1 and 3, second end 7 of ladder 2 is securely fastened to bottom wall 9 of box 8 by large eye bolts 30 and corresponding nuts 31. If required for a particular application, box 8 could be positioned lower, and eye bolt 30 or similar anchor could be fastened through a horizontal member 26 adjacent the floor of the building (FIG. 3).

Figure 4:
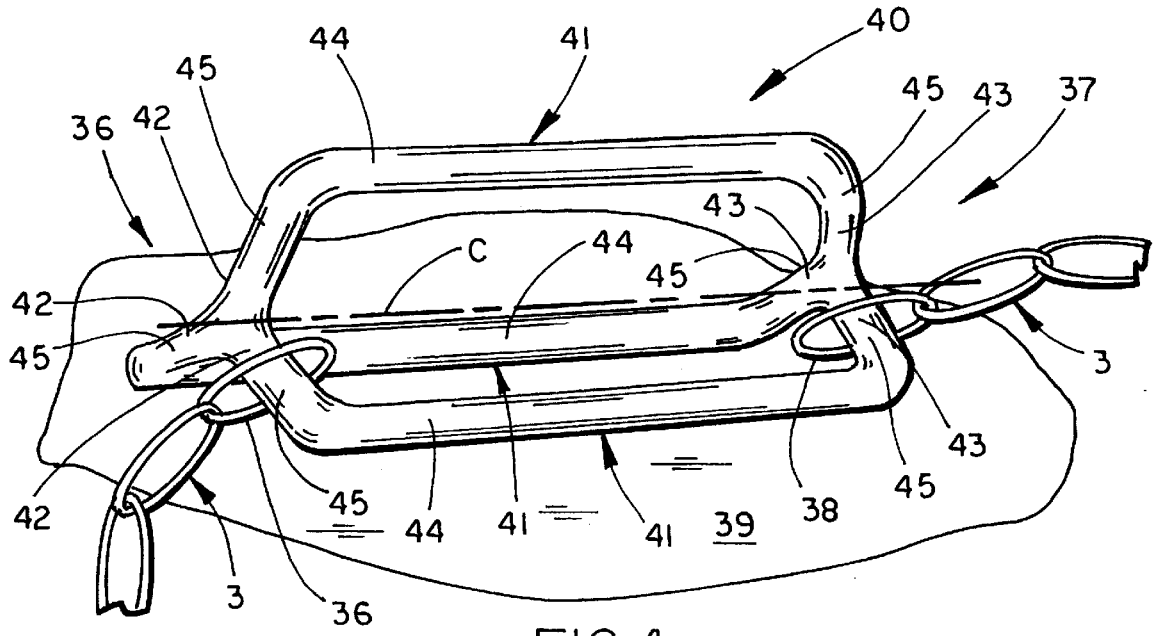
FIG. 4 is a partially fragmentary, perspective view of a handle link including integral stand-offs for use in a fire escape ladder.

With reference to FIG. 4, ladder 2 of the present invention includes a handle link 40 that forms a part of chains 3. Handle link 40 includes at least three elongate rigid handle sections 41 that are rigidly interconnected. At least two of handle sections 41 form integral stand-offs that are adapted to abut a flat surface such as window sill 39 (FIG. 3) to thereby support a first handle section in a spaced-apart relationship from the flat surface such that a person using the ladder can easily and securely grasp the first handle section. Although handle link 40 could be spaced anywhere along ladder 2 to provide a handle section that is spaced away from the outer surface of a building wall, in a preferred embodiment handle link 40 is located such that it rests on window sill 39 when ladder 2 is in an extended position through the associated window 15. Handle sections 41 are rigidly interconnected at a first end 42, and at a second end 43 and define a center axis "C". Handle sections 41 are equiangularly spaced about the center axis "C", thereby forming 120° angles with respect to one another. Handle sections 41 have a substantially straight, elongate center portion 44 and angled portions 45 at each end thereof. Center portions 44 are parallel to center axis "C". In a preferred embodiment, handle sections 41 of handle link 40 are made from a large diameter metallic wire or rod of about 0.25 inches in diameter. First and second ends 36, 37 of handle link 40 are adapted to interconnect with a link 38 of a chain 3.

Figure 6:
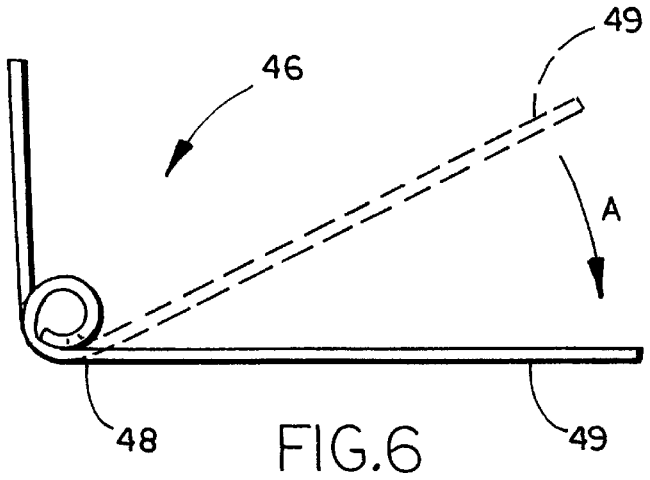
FIG. 6 is a side elevational view of the pivoting stand-offs.
Figure 5:
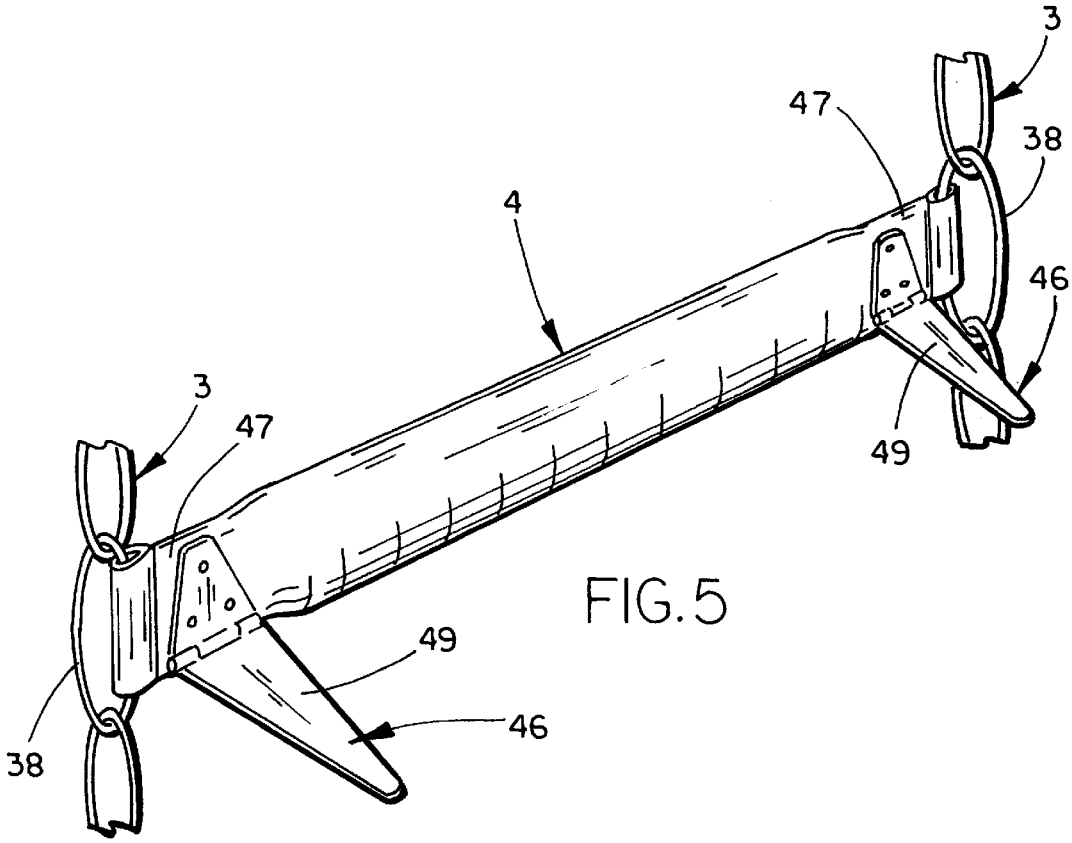
FIG. 5 is a partially fragmentary, perspective view of a rung of the fire escape ladder showing the pivoting stand-offs.

With reference to FIGS. 5 and 6, each rung 4 of ladder 2 is formed from metal such as aluminum and has a tubular cross-sectional shape. Flattened end portions 47 of rung 4 are wrapped around and secured to a chain link 38. A pivoting stand-off 46 is fastened to each flattened end portion 47 and pivot downward in the direction of the arrow "A" due to gravitational force when ladder 2 is in an extended position through associated window 15. Each pivoting stand-off 46 is made from a standard hinge, and includes a stop 48 that prevents extension 49 from pivoting beyond the fully extended position (FIG. 6).

The ladder 2 is normally stored within box 8 with cover 5 covering opening 14. In this condition, the ladder and box are completely within the wall of the building, and the cover 5 is substantially flush with the interior wall of the building formed by wallboard 24. In the event of a fire, the user grasps the handle 29 on the cover 5 and ejects the cover 5 through the associated window 15, and the ladder 2 is fully extended until the handle links 40 rest on the window sill 39. In this position, the ladder 2 may be used to escape from a second story or higher window.

The fire escape apparatus of the present invention provides a compact yet low cost fire escape that may be installed within the wall of a house or similar structure, and does not require the use of a special window frame or similar structure. The handle link provides a secure grip, and insures that at least one of the handle sections is held in a spaced-apart relationship with a flat surface such as the window sill.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The embodiments of the invention in which an exclusive property or privilege is claimed are defined as follows:

1. A self-contained fire escape apparatus adapted for mounting within a building wall, comprising:

a collapsible ladder including a pair of chains formed by a plurality of interconnected links, each said chain having first and second ends, wherein at least one of said links is a stand-off link positioned intermediate said first and second ends, said stand-off link having a pair of spaced-apart Y-shaped portions forming opposite end portions of said stand-off link, each said Y-shaped portion defining three radially-extending legs having outer ends, said stand-off link further including three parallel spaced-apart elongated portions spanning between and interconnecting said outer ends of said legs of Y-shaped portions;

a container adapted to receive said collapsible ladder therein for storage, said container adapted to be mounted wholly within an existing building wall.

2. The fire escape apparatus set forth in claim 1, wherein:

at least one said link is connected to each Y-shaped portion of said stand-off link.

3. The fire escape apparatus set forth in claim 1, wherein:

said container is a box having an opening in a sidewall for retrieval and storage, and said first ends of said chains are secured to said box.

4. A combination building wall and self-contained fire escape apparatus mounted within a building wall, comprising:

a building wall including a vertically extending planar outer layer forming an exterior wall surface and a vertically extending inner layer spaced-apart a constant distance from said outer layer to define a cavity between said inner and outer layers, said cavity having a uniform transverse dimension from a floor height to an overhead ceiling height within said building wall, said inner layer defining a planar inner surface extending uninterrupted from a floor height to a ceiling height;

said building wall including a plurality of horizontally spaced-apart upright structural members disposed within said cavity and extending from a floor height to an overhead ceiling height, said building wall further including a window opening therethrough located above at least a portion of said cavity and including a horizontal sill permanently affixed to said building wall; said vertically extending inner layer having an access opening therethrough;

a collapsible ladder;

a cover securely attached to a first end of said ladder;

a box structure configured to provide storage space for said ladder comprising a bottom wall, vertically extending front and rear walls, a pair of sidewalls and an opening in said front wall aligned with said access opening, a second end of said ladder being securely fastened to said box, said cover releasably attached to said box to cover at least a portion of said opening in said vertically extending front wall, such that a person can manually remove said cover and eject said cover and said first end of said ladder through the window opening, said box mounted within said cavity of said building wall between a pair of said upright structural members of the building wall, and said collapsible ladder being sufficiently small in its collapsed condition that it fits within said box; and wherein:

said collapsible ladder has a first end secured to said box structure and includes a stand-off handle link positioned along said ladder adjacent said first end and having three elongate parallel portions, two of said elongate parallel portions abuttingly contacting a horizontal upper surface of said sill when said ladder is extended through said window, said elongate parallel portions extending horizontally, at least one said elongate portion spaced-apart from said horizontal upper surface to provide a handle for a user.

5. The combination building wall and self-contained fire escape apparatus of claim 4, wherein:

said stand-off link includes a pair of spaced-apart Y-shaped portions with said three elongate parallel portions extending between and interconnecting said Y-shaped portions.

6. The combination building wall and self-contained fire escape apparatus of claim 5, wherein:

said box is secured to a pair of said upright structural members.

* * * * *